United States Patent [19]

Fischer

[11] 4,273,331

[45] Jun. 16, 1981

[54] TENNIS-RACKET

[76] Inventor: Werner Fischer,
Lichtenburgerstrasse 13, 8313
Vilsbiburg, Fed. Rep. of Germany

[21] Appl. No.: 858,644

[22] Filed: Dec. 8, 1977

[30] Foreign Application Priority Data

Dec. 10, 1976 [DE] Fed. Rep. of Germany ..... 2656082

[51] Int. Cl.[3] ..... A63B 51/02
[52] U.S. Cl. ..... 273/73 D
[58] Field of Search ..... 273/73 R, 73 C, 73 D, 273/73 E

[56] References Cited

U.S. PATENT DOCUMENTS

| | | | |
|---|---|---|---|
| 3,834,699 | 9/1974 | Pass | 273/73 D |
| 3,921,979 | 11/1975 | Dischinger | 273/73 D X |

FOREIGN PATENT DOCUMENTS

| | | | |
|---|---|---|---|
| 2501659 | 7/1976 | Fed. Rep. of Germany | 273/73 D |
| 267837 | 3/1927 | United Kingdom | 273/73 D |

*Primary Examiner*—Richard J. Apley
*Attorney, Agent, or Firm*—Fitch, Even, Tabin, Flannery & Welsh

[57] ABSTRACT

Tennis rackets or the like having cross and longitudinal strings lying in parallel, adjacent planes in which slidably mounted tubes are provided over the strings, and in which the tubes are fastened together at their respective points of intersection.

6 Claims, 6 Drawing Figures

TENNIS-RACKET

This application is related to my application Ser. No. 794,211 filed May 5, 1977, and entitled "Tennis Racket" which is hereby incorporated by reference.

A popular technique in the game of tennis is imparting spin to the ball. The oblique angle of the racket to its trajectory puts rotation on the ball, which affects the trajectory as well as the rebound. A lateral cut shot is also possible. This gives the ball a curved trajectory and deflects it to the side after the rebound.

A mastery of the spin technique can generally be attained by the average tennis player only after long years of training.

This is where the invention comes in.

The basic objective of the invention is to construct a tennis racket such that a tennis player of average strength is able without a great deal of training and effort to impart spin to the ball as often as he wishes while still keeping control of the ball, as well as in addition to enable a professional trainer to send his pupil balls with spin so that the latter can practice returning them.

These and other objects of the invention will become apparent from the following description, and drawings, of which:

Figure 3:
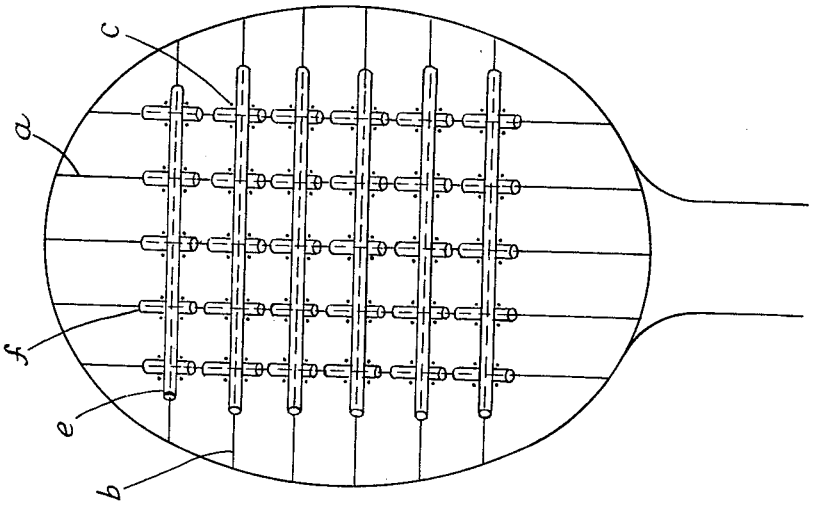
FIG. 3 is an illustration of another racket embodiment in accordance with the present invention utilizing segmented tubing elements drawn over the longitudinal strings and continuous tubing elements drawn over the cross strings thereof.

Generally in accordance with the present invention, rackets such as tennis rackets and the like are provided which utilize a plurality of guide members such as tubing elements disposed on non-interwoven longitudinal and cross strings of the racket. The guide members of the cross strings are connected to the guide members for the longitudinal strings to provide a web which may be deflected upon ball impact. According to the invention, such rackets may be provided by covering each of the cross and longitudinal strings individually with narrow tubing of low-friction synthetic continuously and/or in sections and binding these little tubes firmly together at the points of intersection. The length of the plastic tubes must be such that these end a certain distance from the edge of the tennis racket.

It has also been suggested that the cross and longitudinal strings not be woven together in planes that are parallel and lie very close to one another strung in the frame but rather that only the longitudinal strings be bound together by means of a web of holding strings.

With the tennis racket constructed according to this invention, the tubing web that covers the cross and longitudinal strings but is not connected to them glides along the strings at the impact of the ball. The tubing web can be deflected in all directions. As a consequence of this capacity for deflection, the ball is lifted, whereby the rotation is produced by the recoil of the deflected strings.

Whereas with the conventional tennis racket, the cross and longitudinal strings of which are woven together, the racket must be stroked across the ball as it hits it to produce rotation, a technique very difficult to execute, the ball can be hit almost normally with the tennis racket constructed according to the invention. That is because even a slightly oblique position of the racket suffices to impart a noticeable rotation to the ball through a light cut stroke. This rotation is all the greater, the more pronounced the cut stroke, i.e. the more pronounced the stroking motion of the racket across the ball as it hits it. The rotation can be increased in all cut shots even more when either the cross strings are covered with continuous and the longitudinal strings with sections of rather short narrow tubes which are firmly connected to each other at the intersections, or vice versa, when the longitudinal strings are covered with continuous and the cross strings with sections of rather short narrow tubes bound fast together at the intersections. In this way, the capacity of deflection of the tubing web is improved and consequently the spin on the ball increased.

A further variation of the invention is for the entire tubing web to be composed of rather short sections of narrow tubing which are drawn over the cross and longitudinal strings and firmly connected only at the intersections. In this manner, the capacity of deflection of the tubing web is increased in all directions and thus more spin is imparted to the ball. In place of sections of narrow tubing bound firmly at the intersections, spheres or cubical beads made of low-friction synthetic can also be used, with the bores cross-shaped and one superimposed on the other.

Just as the capacity of deflection of the tubing web can be increased, this capacity can be limited by binding some or all of the tubing drawn over the longitudinal and/or cross strings together by means of threads of synthetic material. The capacity of deflection can further be limited by gluing the rather short sections of tubing which cover the longitudinal strings onto these strings, so that only the rather short sections of narrow tubing covering the cross strings and bound tightly to the longitudinal strings at the points of intersection can glide over the cross strings.

In the subsequent part of the description, examples of several embodiments of the invention are described with the aid of drawings.

Figure 1:
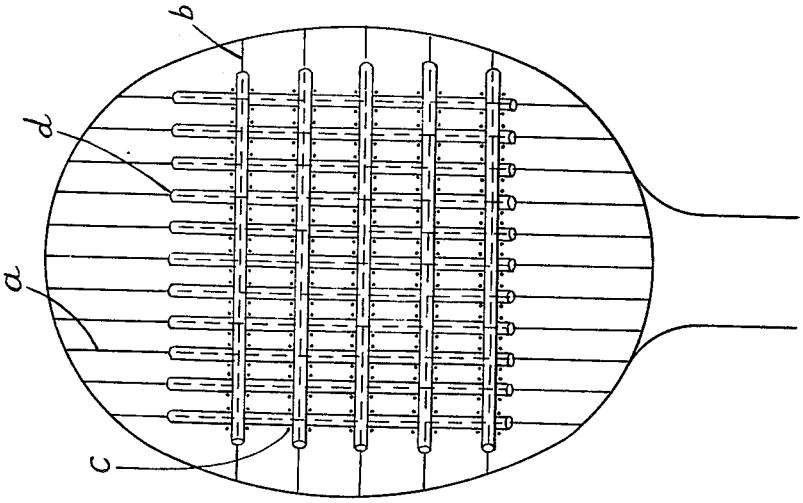
FIG. 1 is an illustration of a racket embodiment utilizing continuous tubing elements drawn over the non-interwoven longitudinal and cross strings thereof.

The drawings illustrate:

FIG. 1: A tennis racket with narrow tubing (d) drawn over each of the longitudinal strings (a) and cross strings (b) and bound tightly together at the points of intersection (c).

Figure 2:
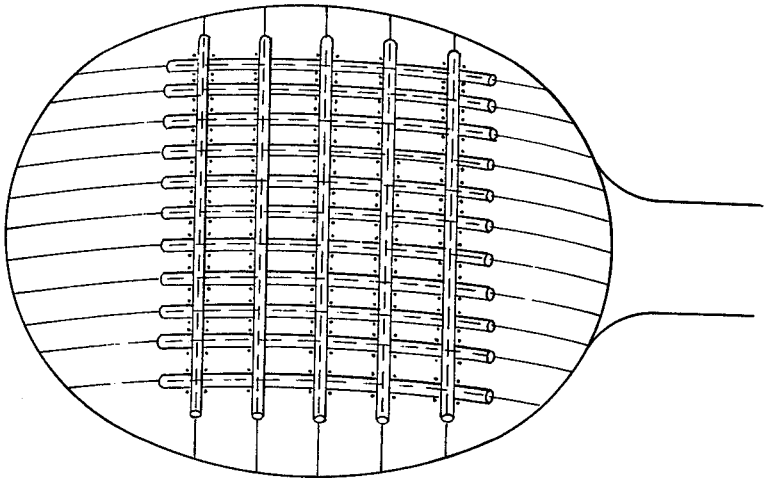
FIG. 2 is an illustration of the racket of FIG. 1 showing the tubing elements thereof in deflected position.

FIG. 2: The tubing web as described in FIG.1 in deflected position.

FIG. 3: A tennis racket with continuous narrow tubing (e) drawn over each of the cross strings (b) individually and sections of narrow tubing (f) drawn over each of the longitudinal strings (a) individually, which are bound firmly at the points of intersection (c).

Figure 4:
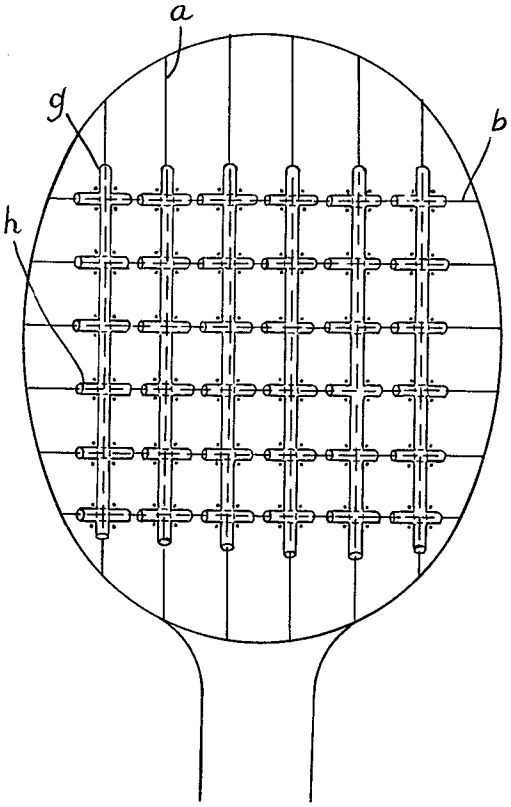
FIG. 4 is an illustration of a further racket embodiment with continuous tubing elements drawn over the longitudinal strings, and seqmented tubing elements drawn over the cross strings.

FIG. 4: A tennis racket with continuous narrow tubing (g) drawn over each of the longitudinal strings (a) individually and sections of narrow tubing (h) drawn over each of the cross strings (b) individually and bound firmly at the points of intersection (c).

Figure 5:
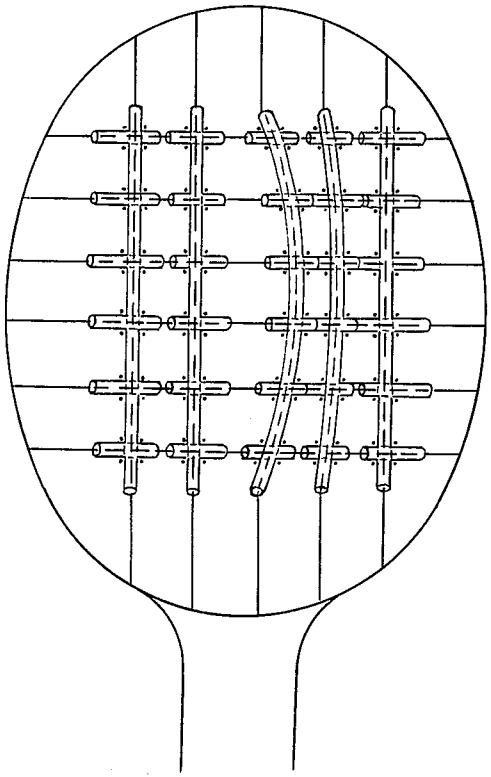
FIG. 5 is an illustration of the racket of FIG. 4 showing the longitudinal strings in a deflected position.

FIG. 5: A tennis racket as described in FIG. 4 in deflected position.

Figure 6:
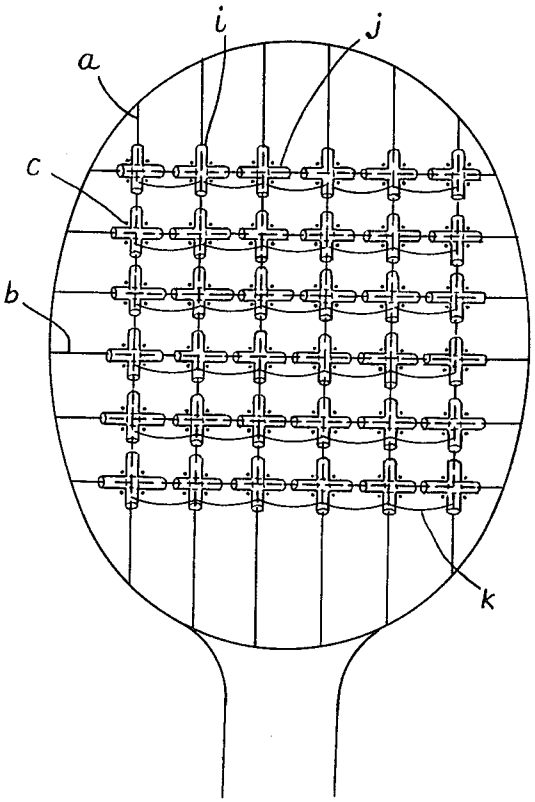
FIG. 6 is an illustration of yet another racket embodiment utilizing a plurality of tubing sections drawn over the cross and longitudinal strings.

FIG. 6: A tennis racket with longitudinal narrow tubing in sections (i) drawn over each of the longitudinal strings (a) individually and crosswise narrow tubing in sections (j) drawn over each of the cross strings (b) individually, whereby the longitudinal tubing sections are bound to each other by means of a thread of synthetic material (k).

The tennis racket constructed in accordance with the invention yields the following technical effect: The tennis player is able with even a slight cut stroke of the racket to impart noticeable spin to the ball. A ball onto which spin is imparted imposes difficulties on the opponent in receiving the ball as well as in controlling its return.

Whereas with a conventionally strung tennis racket, the ball can be given top spin only with a great expenditure of energy, so that only athletic tennis players are capable of this technique, the racket constructed according to the invention can produce the same spin with substantially less expenditure of energy, with the consequence that physically weaker players are also able to impart top spin to balls. In addition, the contol of the ball in cut shots is improved measurably with the racket constructed in keeping with the invention, through the ball's being lifted to a certain extent as it is hit as a result of the tubing web's capacity of deflection and the ball's consequently remaining longer on this tubing web.

If need be, it suffices merely for only the longitudinal or cross strings of the tennis racket's stringing to have continuous or sectioned narrow tubing drawn over them. If need be, further, the thread of synthetic material connecting several or all of the narrow tubes which cover the longitudinal strings can further be bound additionally with a string of the tennis racket frame.

If need be, the narrow tubing that is drawn over each of the longitudinal strings continuously or in sections can be applied in the same form doubly, so that the cross tubing lies between them. Similar adaptations can be effected with the cross tubing.

I claim:

1. A grid for use in conjunction with the strings of a game racket, comprising:

a plurality of first guide members disposed in a first direction to be disposed on a plurality of first strings of a game racket for receiving and guiding the movement of said first strings, and means for connecting said first guide members to form a unitary grid having a plurality of open areas so that when said grid is disposed on said first strings of a game racket, said grid moves substantially as a unit, and so that said grid and said first strings of the game racket move as a unit and slide relative to second strings transversely-disposed to said first strings of the game racket when struck by a ball to increase the amount of spin imparted to said ball.

2. A tennis racket or the like comprising a racket frame, a plurality of longitudinal strings in said frame, and a plurality of cross strings in said frame, said cross strings and said longitudinal strings lying in respectively parallel planes, a plurality of longitudinal string guide members disposed on said longitudinal strings, said longitudinal string guide members being free to glide along said longitudinal strings, a plurality of cross string guide members disposed on said cross strings, said cross string guide members being free to glide along said cross strings, said longitudinal guide members and said cross string guide members being fastened together at their adjacent points of intersection to form a web which may be readily laterally deflected in the planes of the longitudinal and cross strings upon ball impact and which readily recoils during the time of ball contact to impart spin to the ball.

3. A tennis racket or the like in accordance with claim 2 wherein said cross string guide members comprise a plurality of tubes drawn singly over the respective individual cross strings, and wherein said longitudinal guide members comprise a plurality of relatively short tube segments drawn over each of a plurality of said longitudinal strings.

4. A tennis racket or the like in accordance with claim 2 wherein said longitudinal guide members comprise a plurality of tubes drawn singly over the respective individual cross strings and wherein said cross string guide members comprise a plurality of relatively short tube segments drawn over each of a plurality of said cross strings.

5. A tennis racket or the like in accordance with claim 2 wherein said cross string guide members comprise a plurality of relatively short tube segments drawn over each of a plurality of said cross strings, and wherein said longitudinal guide members comprise a plurality of relatively short tube segments drawn over each of a plurality of said longitudinal strings.

6. A tennis racket or the like in accordance with claim 2 wherein said cross string guide members comprise a plurality of tubes drawn singly over the respective individual cross strings, and wherein said longitudinal guide members comprise a plurality of tubes drawn singly over the respective individual longitudinal strings.

* * * * *